United States Patent [19]

Ayala Vargas

[11] 4,149,370

[45] Apr. 17, 1979

[54] SELF STARTING INTERNAL COMBUSTION ENGINE WITH MEANS FOR CHANGING THE EXPANSION RATIO

[76] Inventor: Eduardo Ayala Vargas, Av. Bogata 697, Mexico City, Mexico

[21] Appl. No.: 772,947

[22] Filed: Feb. 28, 1977

[51] Int. Cl.[2] ..... F02G 3/02

[52] U.S. Cl. ..... 60/39.6; 60/39.78

[58] Field of Search ..... 60/39.6, 39.78–39.81, 60/39.63

[56] References Cited

U.S. PATENT DOCUMENTS

| | | | |
|---|---|---|---|
| 2,688,230 | 9/1954 | Milliken | 60/39.63 |
| 3,775,973 | 12/1973 | Hudson | 60/39.8 |
| 3,839,858 | 10/1974 | Avermaete | 60/39.6 |
| 4,028,883 | 6/1977 | Kahrweg | 60/39.18 B |

*Primary Examiner*—Robert E. Garrett

*Attorney, Agent, or Firm*—Charles Richard Werner

[57] ABSTRACT

A reciprocating internal combustion engine adapted to provide a selfstarting, controlled expansion and a substantially constant volume combustion in combustion chambers separated from the engine compression and expansion cylinders of the engine.

6 Claims, 8 Drawing Figures

SELF STARTING INTERNAL COMBUSTION ENGINE WITH MEANS FOR CHANGING THE EXPANSION RATIO

BRIEF SUMMARY OF THE INVENTION

This invention relates in general to a reciprocating motion internal combustion engine, comprising a bank of compression cylinders and a bank of expansion cylinders in which pistons are connected by means of connecting rods to a common crankshaft, by different devices involved in this engine which has the following characteristics; stores and cools the air compressed by their compression cylinders, between the compression and expansion stages; is selfstarting; and in each expansion cylinder the fuel combustion starts almost when the respective piston begins its upward stroke, when the previous expanding cycle ends in the same expansion cylinder giving almost continuous heating; the expansion ratio between the combustion chambers and expansion cylinders may be variable, and due to the fuel and combustion air being supplied separately into continuous very hot combustion chambers, the increase in pressure is progressive at the same ratio as fuel is injected and ignited into said combustion chambers. These features specific to this engine, make it different from known reciprocating internal combustion engines. This engine may function with combustion at constant volume, constant pressure, or dual between both processes with the only difference in the combustion chambers volume and fuel injection timing, and may burn almost any kind of fuel: liquid or gaseous.

The present description which is the preferred embodiment is for constant volume combustion due the specific heat of the gases is lower when heated at constant volume, which is an evidence of higher thermal efficiency.

This description is based on an engine with a compression ratio of 5.6:1, which is equivalent to a low compression ratio Otto cycle internal combustion engine, and the thermal and mechanical stresses are similar between both engines. This is evidence that this engine may be built with almost the same materials, tooling and technology as the present Otto cycle engines.

DETAILED DESCRIPTION OF THE PREFERRED EMBODIMENT

Figure 1:
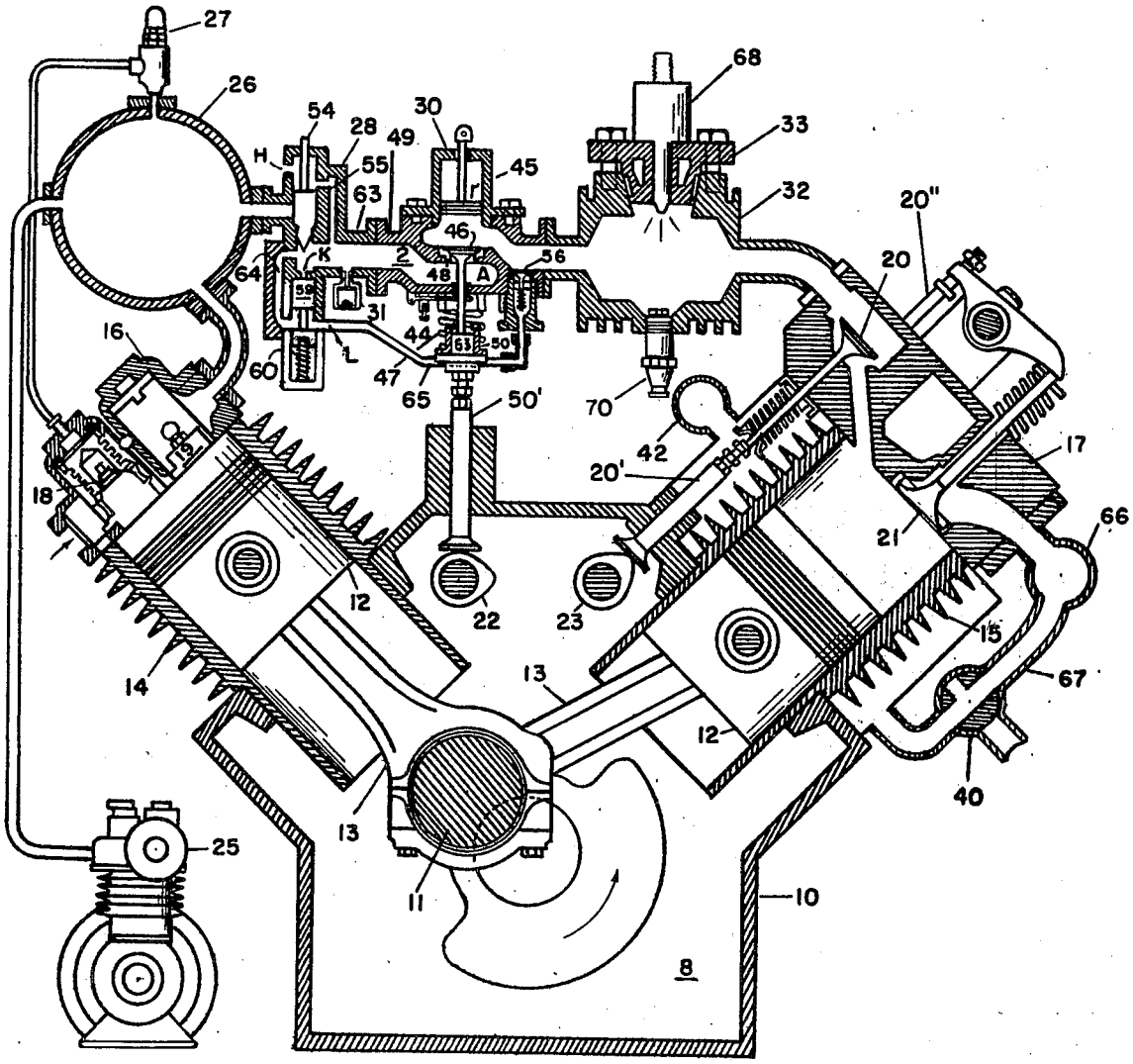
FIG. 1 is a vertical cross sectional view of the engine during the expansion cycle, parts being shown in elevation.

The present invention is illustrated in the accompanying Figures wherein similar components are indicated by the same reference numeral throughout the several views.

This description is for an engine with three compression and three expansion cylinders, with the same bore and stroke with their pistons 120° out of phase between them.

Reference is now made to FIG. 1, where the engine 8, comprising a crankcase with cylinders 14 and 15 in a "V" arrangement, whereby the cylinders 14, operate only as compressors, where each upward travel is a compression stroke, and each downward travel is an air intake stroke. Each cylinder 14 has a head 16, with an intake valve 18, and one discharge valve 19, both valves being operated by means of the air pressure difference flowing there through.

The cylinders 15 operate only as expanders where each downward travel is an expansion (power) stroke and each upward travel is an exhaust stroke, each cylinder 15 having a head 17, with an intake valve 20, and an exhaust valve 21. Both valves are driven by means of the camshaft 23, through push rods 20′ and 20″ at the same rotational speed as crankshaft 11.

The compression cylinders 14, and expansion cylinders 15, have the pistons 12, connected to crankshaft 11, through connecting rods 13.

Atmospheric air is drawn and compressed into compression cylinders 14, and does not flow directly and immediately to the combustion chambers 32, and expansion cylinders 15, but is cooled and stored in reservoir 26.

Between both banks of cylinder 14 and 15, are located the following devices:

Connected to discharge valves 19, from compression cylinders 14, is the reservoir 26, and connected to same, is the unloader valve 27, which actuates through intake valves 18, when the pressure on reservoir 26, reaches the governed pressure and cylinders 14, go to idle.

Valve 27 is also used to send cylinders 14 to idle temporarily in order to get a higher output torque and power in crankshaft 11, which is attained by reducing the power required to drive the compression cylinders 14.

START VALVE 28

Figure 2:
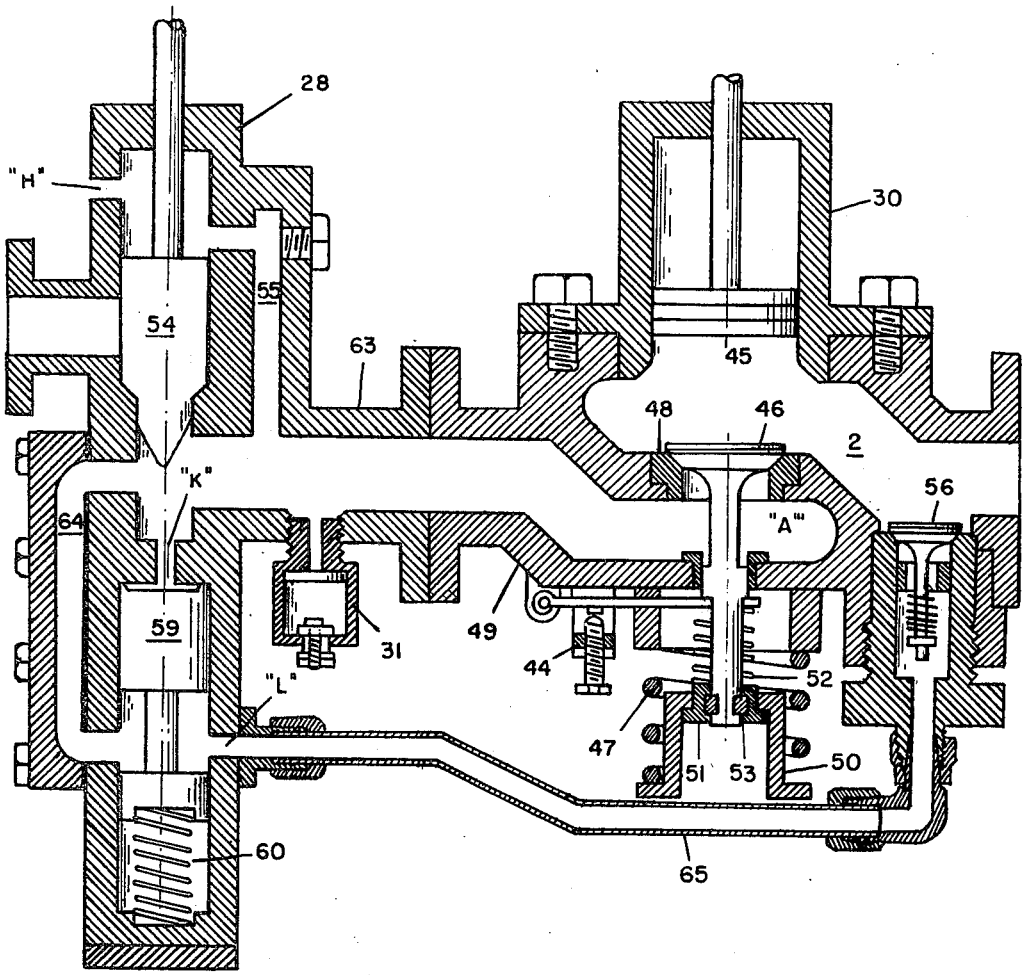
FIG. 2 is an enlarged longitudinal view of the starting valve, and feed valve assembly with their air accumulator.
Figure 2B:
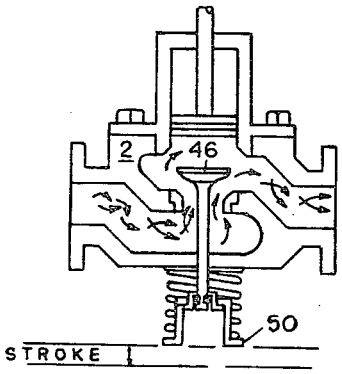
FIG. 2*b* is a reduced longitudinal view of the feed valve assembly with the lower spring plate on top of stroke and the check poppet valve closed.
Figure 2C:
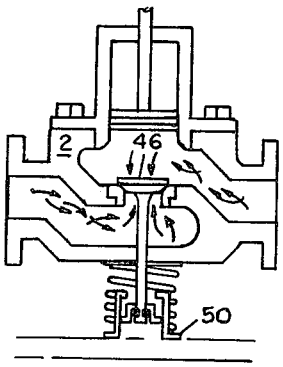
FIG. 2*c* is a reduced longitudinal view of the feed valve with lower spring plate at bottom of the stroke and the poppet check valve closed.
Figure 2A:
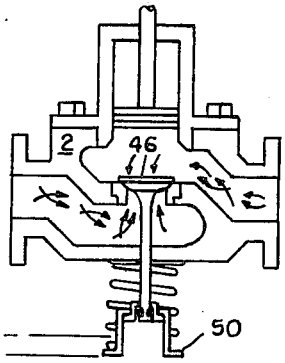
FIG. 2*a* is a reduced longitudinal view of the feed valve assembly with the lower spring plate on top of stroke and the check poppet valve opened.

At the outlet reservoir 26, there is the valve 28, which is used to start the engine 8, said valve being shown in FIG. 1 and in enlarged scale in FIG. 2, at the left side and operates as follows:

When engine 8 is at standstill, the needle valve 54, is in the bottom stroke, pressed against its seat, and the air is not flowing through it from the reservoir 26, to the feed valve assembly 2, at the same time the intake manifold 63 is connected to the atmosphere through the duct 55, and the orifice "H." The piston 59 is held in its top stroke by means of the spring 60, the central groove of piston 59 connects the pipes 65, through the duct 64, to the intake manifold 63, and are opened to the atmosphere, while the valve 54, is at the bottom of its stroke.

When needle valve 54 is lifted to start up the engine 8, the upper face of valve 54, begins to close the orifice "H," and close the communication from the intake manifold 63, to the atmosphere. When the orifice "H" is completely closed, the needle valve 54, begins to open the communication from the reservoir 26, to the chambers "A" of feed valve assembly 2, starting to build up pressure which also actuates the pneumatic start switch 31, opening the electrical normally closed interlocks, and closing their electrical normally open interlock, and at the same time the upper face of piston 59 through the calibrated orifice "K," is communicated to the pressure of intake manifold 63.

In the expansion cylinders 15, whose pistons 12, are beyond their top dead center air pressure from reservoir 26 flows through the duct 64, the central groove of piston 59, pipes 65, valves 56, combustion chambers 32, where is mixed with the fuel discharged by the injectors 68, and ignited by means of the combustion chambers hot walls or the continuous firing spark plugs or glow plugs 70 (if the engine and combustion chambers 32, are cool), intake valves 20, (by-passed the feed valves assembly 2) and discharge their combustion pressure to the upper face of pistons 12, and the crankshaft 11 begins to rotate developing a high useful output torque, but at the same time the air will flow through the reduced orifice "K," and begins to push downward the piston 59 at a controlled speed, and the upper face of their central groove closes the orifice "L," interrupting the air flow from intake manifold 63, during all the time valve 28 is open and engine 8, is running.

The purpose of reduced orifice "K," is to control the downward speed of piston 59, limiting the air pressure in reservoir 26, to the initial revolution of crankshaft 11, when engine 8 is started up.

When valve 54, is pushed downwardly against the valve seat to stop engine 8, the air flow to the feed valve assembly 2, is interrupted and at the same time the intake manifold 63 will be opened to the atmosphere in the same way as previously described, and the upper face of piston 59, through the same orifice "K" will be opened to the atmosphere and spring 60, will urge piston 59 into its upper stroke, which will be again in "start" position. Start valve 28, also can be used in conjunction with the fuel delivery by injectors 68, to help for controlling the output speed and torque developed in crankshaft 11, by means of air flow through the needle valve 54.

FEED VALVE ASSEMBLY 2

At the outlet end of the intake manifold there is located the feed valve assembly 2, with its respective air accumulators 30, one for each expansion cylinder 15, and in said feed valve assembly 2, its valve 46 is driven by means of camshaft 22, through the push rods 50', at the same rotational speed as crankshaft 11.

The function of feed valve assembly 2, is to control the air flow from reservoir 26 to the combustion chambers 32, and accumulators 30. The poppet check valves 46, has the characteristic of a fixed opening point and a variable closing point, functioning as follows:

When valve 28 is closed, the valves 46 are at the bottom of their stroke, urged closed position against valve seat 48 by means of spring 47, which act between the lower side of housing 49, and upper face of lower spring plate 50, which at the same time pushes over the set sleeve 51, upper face and wedges 53, which are fixed to the valve stem 46. Spring 52, also helps to close the valve 46, its acting between the lower side of housing 49, and set sleeve 51.

When valve 54, is lifted to start up the engine 8, there is constant air pressure inside chambers "A," which acts against the lower face of valve 46. However, this pressure is not sufficient to open the valve 46 due to spring 47, acting in the opposite direction with enough force to overcome the air pressure which is acting against the lower face of valve 46, FIG. *2a*, with exception of the feed valve assembly 2, in which lower spring plates 50 are in the upper stroke overcoming the force of spring 47, FIG. *2b*. In these last valves the air pressure urges the valves 46 upwardly (open fixed point), and flows through it and remaining trapped inside the combustion chambers 32, and accumulators 30, starting to build up pressure. When this pressure is the same over both head faces of valve 46, it will close, due to the fact that their upper face is larger, while spring 52, will force valve 46, to close at higher speed, (variable closing point) FIG. *2c*, and at the same time push the syncronization fuel injector's switch 44, which closes their normally opened interlock. Nevertheless, lower spring plate 50, continues in its upper stroke, valve 46 does not reopen while having the gas combustion pressure over its upper face, and when the pressure inside the combustion chamber 32, and expansion cylinder 15, during the expansion process will be reduced to a lower pressure than that on reservoir 26, valve 46 will be steadily seated against the seat 48, by means of spring 47, whose lower spring plate is again in the bottom stroke, FIG. *2a*.

Spring 52, is too light and has only sufficient force to maintain valve 46 closed, when there is no air pressure inside the chamber "A."

As valve 46 has a mechanical driven fixed point for its opening and a pneumatically driven variable point for its closing, the time between both points is the time during which it opens, and depends only the combined volume between the combustion chambers 32, and the accumulators 30, the aperture of valve 54, the temperature of combustion chamber 32, the air temperature and pressure inside the reservoir 26, which always and invariably are combined between them in different proportions, but always closes when the pressure on combustion chamber 32, and reservoir 26, are equal regardless of the factors before mentioned and the opening time of valve 46.

Integral with feed valve assembly 2, above upper face of the valve 46, is located the air accumulator 30, which has a variable volume, said accumulator controls manually or automatically the air trapped in the space defined by the combustion chamber 32, the lower face of piston 45, the valve 46, and intake valve 20, the last mentioned valve remaining closed until the respective piston 12, reaches its top dead center. By means of the variation of air trapped inside the combustion chambers 32, and accumulators 30, with the opening of valve 54, and fuel discharge through injectors 68, it is possible to control at the same time the output torque and rotational speed developed by crankshaft 11.

COMBUSTION CHAMBERS 32

In the outlet of feed valve assembly 2, there are the combustion chambers 32, one for each expansion cylinder 15.

As the maximum compressed air for fuel combustion which may be supplied continuously is that supplied by compression cylinders 14, it is necessary not to reduce and exhaust the volume stored in reservoir 26, so each combustion chamber 32, must have the same volume as those supplied for each compression cylinder 14, at each compression stroke at the pressure governed by the unloader valve 27.

The volume of said combustion chambers 32, is equivalent to the cylinder clearance due compression ratio in the known reciprocating internal combustion engines.

The air heating and combustion of fuel inside the combustion chambers 32, is made in three stages: namely: the first stage which starts the instant valve 46 opens until the instant it closes again, being the time required to fill the combustion chambers 32. The air charge is heated by forced convection at constant pressure. The second stage starts from the instant valve 46 closes, closing at the same time the syncronization switch 44, electrical interlock which start the fuel injection and combustion true at constant volume until intake valve 20, opens. The third heating stage starts at the instant intake valve 20 opens at the top dead center again by forced convection during all the time as expansion continues until exhaust valve 21 opens and the combustion gas exhausts.

At outlet end of combustion chambers 32, there are the intake valves 20, which are driven by means of the camshaft 23, through the push rods 20', at the same rotational speed as crankshaft 11, which connects to the expansion cylinders 15, so the combustion gas pressure discharges over the expansion pistons 12, upper face, during the expansion cycle (power).

FUEL INJECTORS 68, THEIR CONTROL AND POWER SUPPLY

On the upper face of combustion chambers 32, and mounted on the cooled inserts 33, are the fuel injectors 68, which in the present description example are for liquid fuel, similarly to that known and used in the internal combustion diesel engines, but it is preferred their electro magnetic driving, due that engine 8, here described can be started up itself from zero velocity and the mechanical driving injection fuel pumps and fuel injectors perform very faulty when they are impelled at very low speeds, and on the other hand it is also required that during the start, the fuel injection be in any expansion piston 12 position in a range covering the angle between closing valve 46, and opening exhaust valve 21. When the engine is running the fuel injection stroke always starts the instant valve 46, closes.

The two conditions mentioned before are overcome by use of the electromagnetic fuel injectors, which for a given fuel injection volume have an injection stroke and velocity constant independent to the rotational speed of the engine over which they are acting, and said fuel injection stroke starts with an electrical impulse, which can be given even with the engine 8, at standstill.

A proposed typical electrical wiring diagram for the electromagnetic fuel injectors is shown on FIG. 4, and operates as follows:

Fuel to the injectors 68 is supplied constantly by a pressure rotary pump (not shown), and when the engine 8 is at standstill before it is turned on, the electrical condensers 37, are charged from an electrical source (not shown) via the pneumatic start switch 31, normally closed interlocks. When the needle valve 54, is lifted for turned on the engine 8 starts to build up air pressure inside the intake manifold 63, which acts over the pressure start switch 31, opening their normally closed interlocks, and at the same time closes their normally opened interlock and also filling the feed valve assembly 2, and when their respective combustion chambers 32, are completely filled with air their valves 46 close, thus closing their syncronization fuel injection switches 44, and the condensers 37 will be electrically discharged into the coil of the respective fuel injector 68, at all those expansion cylinders 15, in which pistons 12 are at an angle equal to the rotating electrical distributor 35, contact angle which starts shortly after their bottom dead center, and ends shortly before the exhaust valve 21, of expansion cylinders 15 opens. The rotating electrical distributor 35, (not shown in FIG. 1) is driven by the camshaft 22, at the same rotational speed as crankshaft 11. Fuel injected into the combustion chambers 32, is ignited as before mentioned at the same ratio as it is injected into the combustion chambers 32 and also on the expansion cylinders 15, whose pistons 12 are beyond their top dead center in their expansion cycle.

Due to the previously mentioned operation, there are practically no combustion explosion due the fuel being ignited progressively at the same ratio as it is injected.

When the engine 8 is already functioning, the start switch 31, has its normally closed interlocks permanently opened and the condensers 37 are charged at each revolution of crankshaft 11, via the normally closed interlocks of rotating electrical distributor 35, during the early exhaust stage cycle of expansion cylinders 15, and discharges into the coil of respective fuel injector 68, constant at the instant at which the valve 46 closes, actuating the syncronization fuel injection switch 44, closing again the normally closed electrical interlock when their respective combustion chamber 32 are completely filled with compressed air, starting at this moment the fuel injection and the combustion.

The rotational speed, torque and power developed by crankshaft 11, are controlled by the volume of fuel injected which is governed by means of the electrical discharge of condensers 37 into the coil in the fuel injectors 68, which is adjusted by the throttling electrical variable resistor 43.

Inductances 38 are connected in series between the normally closed interlocks of syncronization fuel injection switches 44, and the fuel injector coils to produce a good and rapid deenergizing of said fuel injector coils.

AUXILIARY COMPRESSOR 25

On the left side, lower portion of FIG. 1, there is indicated the auxiliary air compressor 25, which is driven independently from the engine 8, and acts to maintain the reservoir 26 fully air charged when the engine 8 is at standstill, with the same pressure as that developed by compression cylinders 14.

As reservoir 26 is permanently charged at the same pressure as that developed by the compression cylinders 14, it is possible to start up engine 8, as previously described, and if said engine 8 has three or more expansion cylinders 15, with their pistons 12 out of phase in angles equal to 360 divided by the number of said cylinders, always may start up in any position of crankshaft 11, developing an useful output torque.

Auxiliary compressor 25 also acts as a booster when it is running at the same time as the engine 8, due to the fact it is furnishing an additional air volume, sufficient to maintain filled at the same time the combustion chambers 32, and the accumulators 30.

The function of compressor 25, as a booster, is described in "Air accumulators 30 addition."

Compressor 25 can also be one with a higher pressure discharge than that of the compression cylinders 14, and discharge into a higher pressure reservoir (not shown), for extracting directly from this reservoir and for short time periods the air at higher pressure, to increase the maximum and medium effective pressures into expansin cylinders 15. In such case, the high pressure reservoir also feeds the reservoir 26, through a pressure reducing valve (not shown), to furnish the same pressure as is developed by compression cylinders 14, in the same way as the low pressure compressor 25, discharging directly into reservoir 26.

As the function of air compression and combustion gas expansion are separated each one in a cylinder bank, only the expansion cylinder 15, is described, due to the compression cylinders 14, functioning as any reciprocating compressor, independently but driven by the same crankshaft 11.

EXPANSION CYLINDERS 15

Expansion cylinders 15, with their pistons 12, have two working cycles as follows:

1. Expansion, with an effective stroke from the top dead center up to the moment in which exhaust valve 21, opens approximately 160°.
2. Exhaust, which starts before intake valve 20 closes, and ends before the top dead center, for compressing a small combustion gas volume remaining inside the cylinders 15, to fill the small volume due to piston clearance and outlet duct of intake valve 20, at a pressure close to that inside the combustion chambers 32, in order to prevent a pressure loss when intake valve 20 opens.

At the expansion cycle end, there is an overlap between the intake valve 20, and exhaust valve 21, where both valves remain open at the same time, whereby the pressure inside the combustion chambers 32, and expansion cylinders 15, will be reduced simultaneously.

VALVES AND FUEL INJECTORS TIMING

Figure 3:
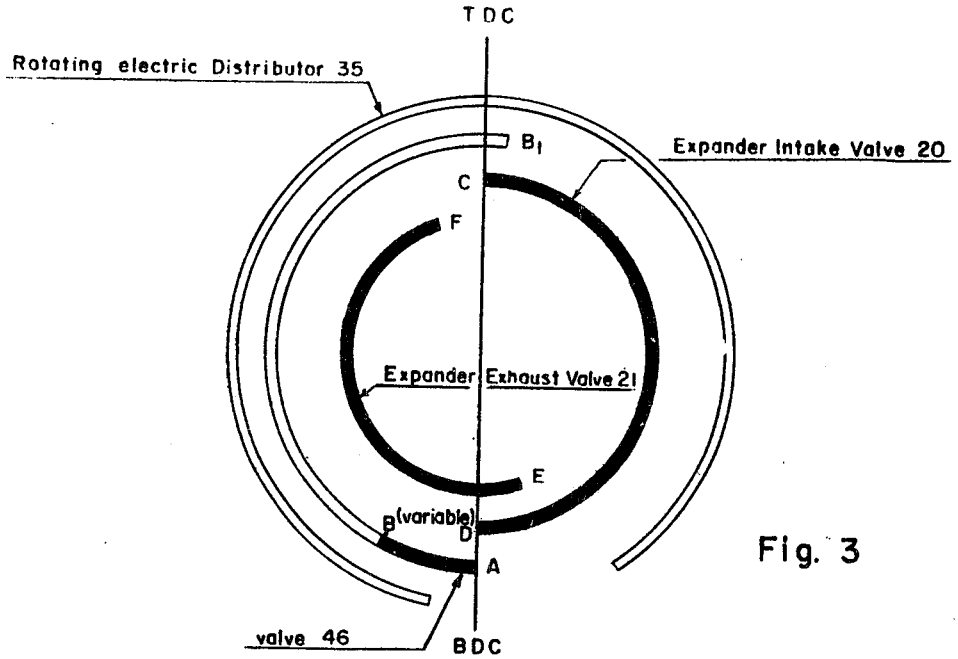
FIG. 3 is a theoretical valve and fuel injector timing diagram for the expander inlet valves, the expander exhaust valves, the feed valve assemblies and fuel injectors.

FIG. 3, shows a diagram with the theoretical valve time opening for feed valve 2, intake valve 20, exhaust valve 21, and delivery stroke of fuel injector 68. Starting the cycle at the bottom dead center with intake valve 20 closed, point "D," camshaft 22, opens the valve 46, point "A" and the filling of combustion chamber 32, and heating begins by forced convection in this first stage, valve 46, will remain open until the pressure of combustion chamber 32, will close, point "B" (variable) starting at this instant the fuel injection and combustion, second heating stage.

At the top dead center, camshaft 23 opens the intake valve 20, point "C," starting the third heating stage, again by forced convection during all the expansion cycle.

Before the bottom dead center is reached, the camshaft 23 opens the exhaust valve 21, and the combustion gas exhaust to the atmosphere through the exhaust manifold 66, ending the working fluid heating, point "E;" exhaust valve 21, remaining open for about 170°, and closes before the top dead center is reached, point "F."

Between the instant valve 21 opens, point "E," and the instant at which intake valve 20 closes, point "D," at the bottom dead center point is the valves overlap angle between admission valve 20, and exhaust valve 21.

Between the intake valve 20 opens, point "C," and exhaust valve 21, opens, point "E," is the angle of the effective stroke of piston 12.

Between the exhaust valve 21 closes, point "F," and intake valve 20 opens, point "C," is the angle which expansion cylinder 15, with piston 12, functioning as compressor to compensate their own clearance.

Between the point "A," to the point "$B_1$" of valve 46, is the angle at which said valve may be opened, provided there is no combustion chamber 32 pressure over their upper head face, point "B," is the instant at which it closes, and fuel is injected and ignited (variable).

HEATING AND COOLING SYSTEMS

As compression cylinders are on one bank and expansion cylinders on the other bank, there is a cool cylinder bank while the other is hot, whereas both cylinder banks function closest to their isothermal process, if the compression cylinders 14 are cooled and the expansion cylinders 15, are maintained hot, even with the engine 8, working at reduced load or in standby.

The expansion cylinders may be heated externally with the help of their combustion gases exhaust which are discharged through the exhaust manifold 66, to the heating duct 67, three ways thermostatic valve 40, to the heating chamber 36, lower end, heat externally the expansion cylinders 15, and being discharged to the atmosphere through the duct 42.

As the expansion cylinders 15 also are heated internally by the same combustion gases, the valve 40, is thermostatically actuated to control the combustion exhaust gas flow from the heating duct 67, directly to the atmosphere, bypassing the heating chamber 36, to maintain a constant temperature regardless of the load rate, or furnishing additional heat when operating at reduced load, to increase the thermal efficiency.

The expansion cylinders 15 also can be heated if the combustion chambers 32 are cooled inside a cooling chamber (not shown) by means of a cool air flow delivered by a blower which discharges into the said cooling chamber of combustion chambers and their exhaust ducted directly to the heating chamber 36 of expansion cylinder 15.

The compression cylinders 14 can be cooled by the aspiration of the same blower for heating the combustion chamber 36.

ENGINE OPERATIONAL SEQUENCE

As a working example for engine 8, it is considered that before the engine begns to run, the pistons 12, corresponding to the expansion cylinders are: the first on the top dead center, the second, 120° before the top dead center and the third 120° after the top dead center.

When valve 54 is lifted, the air stored in reservoir 26, which is at the discharge pressure of compression cylinders 14, flows from one side through feed valve assembly 2, which corresponds to the first and second expansion cylinders in which their lower spring plates 50 are in their upper stroke, but as the intake valves 20 correspond to these expansion cylinders, they are closed, the compressed air will be trapped inside the combustion chambers 32, corresponding to said expansion cylinders 15, and when the combustion chambers 32 will be filled with compressed air and at the same reservoir 26, pressure, their fuel injection syncronization switch 44, closes again their electric interlock, which starts the fuel injection and combustion, but the increase in pressure due to the fuel combustion remains trapped inside said combustion chambers 32, until the intake valves 20 of respective expansion cylinders 15 will be opened.

On the other hand, in the third expansion cylinder 15, the compressed air flows from valve 54, through duct 64, central groove of piston 59, pipe 65, valve 56, (bypassed their feed valve assembly 2), combustion chamber 32, and intake valve 20, which is opened, and when the air pressure inside both the third expansion cylinder 15 and their combustion chamber 32, are full at the same pressure as reservoir 26, the start switch 31 closes the normal open interlock which starts the fuel injection, ignition and combustion into the complete air charge at both the combustion chamber 32 and expansion piston 15, increasing the pressure which acts over the upper face of piston 12, and starts the rotation of crankshaft 11. At the same time, the compressed air flows through the reduced orifice "K," pushing the piston 59 downwards.

As soon as the crankshaft 11, begins to rotate, the intake valve 20, which corresponds to the first expansion cylinder 15 will open and the combustion gas trapped inside the combustion chamber 32, from valve 46 was closed, discharges its pressure over piston 12, with the pressure reached due to the fuel combustion, and the work from said piston 12 will be added to the work of the piston 12 of third cylinder 15 and continuing until the exhaust valve 21 of third cylinder 15 is opened, and the combustion gas begins to exhaust to atmosphere through the exhaust manifold 66, but in the meantime piston 12 of second cylinder 15, will pass the respective top dead center, acting as previously described for the piston 12, of first cylinder 15.

At the same time when piston 12, of third cylinder 15, has rotated the initial 60° after crossing over their bottom dead center the camshaft 22, pushes the lower spring plate 50, corresponding its feed valve 2, to its top stroke, and the valve 46 will be free and will be opened by the compressed air pressure, thus starting the heating and fuel combustion of the "next" working fluid charge inside the combustion chamber 32, until the expansion piston 12 passes its top dead center and the intake valve 20, will be opened and the working fluid will be discharged again over the second and first pistons 12, and so forth in the three expansion cylinders 15.

At the same time, the compression cylinders 14, will be replenishing the air used on combustion chambers 32, and expansion cylinders 15.

THEORETICAL ENGINE PERFORMANCE

The performance of engine 8, is based on the fact that it has the same number of compression cylinders 14, and expansion cylinders 15, with same bore and stroke, the fuel combustion being true at constant volume, and in this preliminary description there is considered the volume only of combustion chambers 32, without any additional volume due to accumulators 30.

Figure 5:
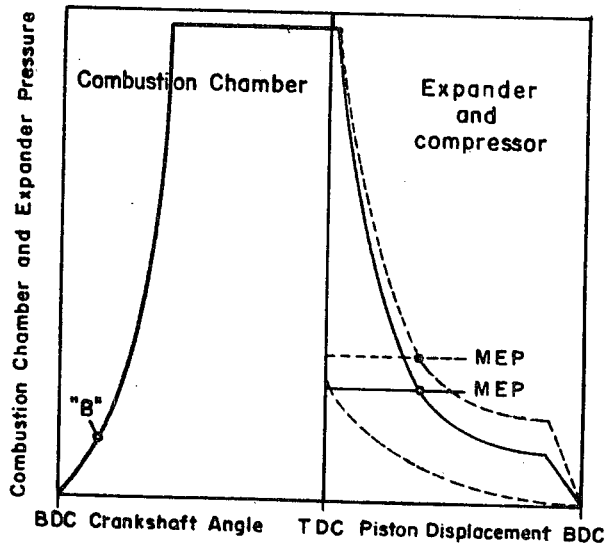
FIG. 5 is a performance diagram of the engine, without any air volume in their accumulators, and with an air volume in their accumulators equal to 50% of the combustion chambers volume.

FIG. 5, shows the theoretical engine 8 performance, at their T.D.C., left hand side, shows the evolution pressure inside combustion chambers 32. The "B" designated circle indicates the instant at which the valve 46 closes, starting the fuel injection and combustion.

On the right hand side T.D.C., the full line shows the pressure gradient on the expansion cylinders 15, over pistons 12.

The dotted lower line shows the compression pressure developed inside the compression cylinders 14, and the lower horizontal line in full identifies the medium effective pressure.

ACCUMULATORS 30, ADDITION

If the volume of an accumulator 30 is added to combustion chamber 32, it will increase the total air volume trapped inside them, increasing the pressure in the expansion cylinder 15, over the piston 12, during the expansion cycle, given by the combustion gas pressure trapped at both, accumulator and combustion chamber, multiplied by the volume sum of combustion gas trapped inside combustion chamber 32, plus the volume of accumulator 30, and divided by the sum of combustion chamber 32, volume, plus the volume of accumulator 30, plus the volume of expansion cylinder 15 at each given time, which goes from a volume equal to that of combustion chamber 32, plus accumulator 30, up to the maximum when exhaust valve 21, opens.

The volume of accumulators 30, which is added to the combustion chambers 32, will change the expansion ratio, giving as a result the pressure during the expansion cycle and the medium effective pressure increase.

Increasing the medium effective pressure, the output torque is increased also, increasing in addition the power at the same rate as the speed of piston 12, increases.

The upper dotted line indicates the new performance adding the volume of accumulators 30, which has a capacity equaling 50% of that of the combustion chambers 32, giving a medium effective pressure increased as shown in the upper horizontal dotted line.

As the output torque and power developed by crankshaft 11 are controlled by means of the volume in combustion chambers 32, and accumulators 30, combined, and the fuel injection delivery by fuel injectors 68, it is possible to achieve an output torque maximum at zero velocity and approximately inversely proportional to the crankshaft 11, rotational speed as those required by the automotive and railroad vehicles, with a sequence as follows:

From 0 rpm or (0-kph) to maximum speed in rpm or kph.

1. Accumulators 30, with their maximum volume, maximum fuel injection and by means of unloader valve 27, the compression cylinders 14, are sent to idle.
2. The compression cylinders 14, are sent to compression.
3. To reduce the volume of accumulators 30, from maximum to minimum, and at the same time, controlling the fuel injection.
4. Total suppression of accumulators 30, and controlling the increase in crankshaft 11, rotational speed by the fuel injection delivery.

MODIFICATIONS

The specifications of before mentioned engine 8, corresponds to their basic embodiment, but it may be modified by one of the following devices:

Feed valve assembly 2, with their outlet duct configuration as a "Venturi nozzle" for increasing the discharge air speed and kinetic energy.

A cooling coil placed between the feed valve 2, outlet duct, and inlet end to combustion chambers 32, to reduce the temperature in this zone to avoid an early discharge air expansion.

A fuel injection system in which the fuel injection begins slight before th top dead center when the engine 8 is started up, and is advanced toward the valve 46, closing point when the engine 8, is running as the crankshaft 11 rotational speed increases.

Figure 4:
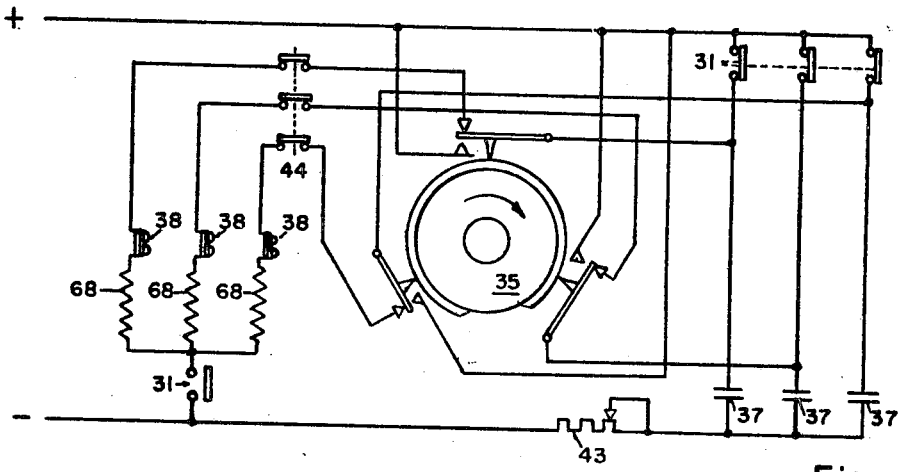
FIG. 4 is a typical electrical wiring diagram for fuel injectors with the starting valve closed and engine at standstill.

In this embodiment the electrical wiring is the same as shown in FIG. 4, but with the fuel injectors syncronization switches 44, suppressed, and the rotating electrical distributor 35, with a reduced contact angle which allow fuel injection only from near the top dead center when the engine 8, is at stand still and said rotating electrical distributor 35, contact angle is advanced toward the valve 46, closing point by means of a servo mechanism when the engine 8 is running.

The starting up of engine 8 can be improved with the use of some commercial compressed air rotating distributor as those known and used for starting some Diesel engines, said rotating distributor can be drived by any of the camshafts 22 or 23, and must have one distribution element for each expansion cylinder 15, and must be placed between each pipe 65, said rotating distributor permits the flow of compressed air from reservoir 26 only at the same angle as the expansion pistons 12 are dephased between them, this angle beginning from the bottom dead center of the respective expansion piston 12, and ends before its exhaust valve 21 opens, which prevents any loss in the compressed air in those expansion cylinders 15, whose expansion pistons 12 are beyond the point of aperture of exhaust valve 21 when the valve 54 is lifted for start up the engine 8. This rotating distributor is automatically withdrawn from compressed air circuit as soon as the central groove of piston 59 closes the orifice "L" interrupting the flow of compressed air through the pipes 65.

Although this invention has been described by specific embodiment and example, it will be obvious to one skilled in the art that its teachings may be employed in other ways, and the scope of invention should not be deemed to be limited by the precise certain embodiments, and modifications herein described, disclosed, illustrated and shown, since other embodiments and modifications are intended to be reserved where they fall within the scope of the claims herein appended.

I claim:

1. A self starting heat engine with means for changing the expansion ratio therein, comprising: a bank of cylinders comprising at least one air compression cylinder having a cylinder head including means for controlling the air admission and discharge, said compression cylinders supplying compressed air for fuel combustion in combustion chambers; a second bank of cylinders comprising at least one expansion cylinder where the products of fuel combustion in said combustion chambers are expanded to produce the engine power; each one of said expansion cylinders having a cylinder head comprising means for controlling the admission end exhaust of said products of combustion; a piston in each of said compression and expansion cylinders, a connecting rod carried by each of said pistons, a cylinder block in which is mounted a crankshaft, each of said connecting rods being connected to said crankshaft, said cylinders block comprising actuator means for said means for controlling the admission and exhaust of the products of combustion in said expansion cylinders, each one of said compression cylinders being connected to a compressed air reservoir, a starting valve connected to said compressed air reservoir, an air feed valve for each one of said expansion cylinders connected to said starting valve, said air feed valves comprising: a check valve which is actuated by said actuator means and by the pressure of the air flowing through said air feed valve, said check valve comprising means to prevent back flow of combustion gas from said combustion chambers toward said compressed air reservoir, a gas accumulator connected to the outlet duct of said air feed valve and comprising means for changing the gas volume which can be stored in said accumulators and said combustion chambers, and which is the gas volume to be expanded in its respective expansion cylinder; each of said air feed valves being connected to each of said combustion chambers, said combustion chambers having fuel injection and fuel ignition means; each of said combustion chambers being connected to each of said expansion cylinders and forming a gas flow circuit between said compression cylinders and said expansion cylinders; an auxiliary air compressor connected to said gas flow circuit before said starting valve and means for governing the delivery of compressed air to said compressed air reservoir and for placing in idle said compression cylinders.

2. The engine as disclosed in claim 1, characterized in that said means to prevent back flow of combustion gas from said combustion chamber toward said compressed air reservoir includes a second check valve in the outlet duct of said air feed valve, said second check valve being actuated by the gas flowing through said air feed valve.

3. The engine as disclosed in claim 1, characterized by including a movable hollow plunger within a plunger liner located at the end of the admission duct of said air feed valve, said hollow plunger being divided in two internal portions by means of an internal partition, one of said internal portions connecting through at least one radial duct with a circular groove surrounding said hollow plunger, the outer face of said internal portion comprising the valve seat of said check valve, said hollow plunger being actuated by means of said actuator means to communicate with an admission port in said plunger liner to provide for air flow from said compressed air reservoir when said circular groove is positioned ahead to said admission port, and closes the air flow when said circular groove is positioned beyond the edge of said admission port, a spring between the housing of said air feed valve and the outer end of said hollow plunger for maintaining the circular groove of said hollow plunger out of communication with said admission port, a spring of low compression force than the first mentioned spring in the other hollow portion of said hollow plunger, acting against said internal partition and the end of the stem of said check valve to close said check valve against the valve seat of said hollow plunger when the pressure within said combustion chambers is equalized with the pressure in said compressed air reservoir, this action being performed irrespective of the time which said check valve remains open and the stroke travelled by said hollow plunger at the moment when the pressure in said combustion chamber and said compressed air reservoir are equalized.

4. The engine as disclosed in claim 1, characterized in that said air feed valves have a blind flange in the flange connecting said air feed valve and said gas accumulator to supress said gas accumulator.

5. The engine as disclosed in claim 2, characterized in that said air feed valves have a blind flange in the flange connecting said air feed valve and said gas accumulator in order to supress said gas accumulator.

6. The engine as disclosed in claim 3, characterized in that said air feed valves have a blind flange in the flange connecting said air feed valve and said gas accumulator in order to supress said gas accumulator.

* * * * *